US008418429B2

(12) United States Patent
Li et al.

(10) Patent No.: US 8,418,429 B2
(45) Date of Patent: Apr. 16, 2013

(54) BOTTLE SUPPORTING MEANS WITH CLUTCH

(75) Inventors: Xinhua Li, Changsha (CN); Niansheng Yang, Changsha (CN); Zhen Liu, Changsha (CN); Jianyong Liu, Changsha (CN); Zhimin Duan, Changsha (CN); Yue Tang, Changsha (CN)

(73) Assignee: Truking Technology Limited, Changsha, Hunan (CN)

( * ) Notice: Subject to any disclaimer, the term of this patent is extended or adjusted under 35 U.S.C. 154(b) by 356 days.

(21) Appl. No.: 12/811,379

(22) PCT Filed: Dec. 30, 2008

(86) PCT No.: PCT/CN2008/073840

§ 371 (c)(1), (2), (4) Date: Jul. 1, 2010

(87) PCT Pub. No.: WO2010/045772

PCT Pub. Date: Apr. 29, 2010

(65) Prior Publication Data

US 2010/0281826 A1 Nov. 11, 2010

(30) Foreign Application Priority Data

Oct. 20, 2008 (CN) ..... 2008 1 0143368

(51) Int. Cl.
*B67B 3/28* (2006.01)

(52) U.S. Cl.
USPC ..... 53/317; 53/331.5

(58) Field of Classification Search ..... 53/317–318, 53/331.5, 332, 302, 227; 74/606 R
See application file for complete search history.

(56) References Cited

U.S. PATENT DOCUMENTS 3,831,344 A * 8/1974 Over ..... 53/329

FOREIGN PATENT DOCUMENTS

CN 2897979 Y * 5/2007
WO WO 2007119146 A2 * 10/2007

* cited by examiner

*Primary Examiner* — M. Alexandra Elve
*Assistant Examiner* — Andrew M Tecco
(74) *Attorney, Agent, or Firm* — Raymond Y. Chan; David and Raymond Patent Firm

(57) ABSTRACT

A bottle support with clutch includes a tray (1), a small gear (2), a shell (3) and a rotary table (5). The shaft sleeve of the small gear (2) is connected with the shell (3) through a bearing (7). The shell (3) is connected with the rotary table (5). The shaft sleeve of the tray (1) is sleeved in the shaft sleeve of the small gear (2), and a clutch (8) is provided between the shaft sleeve of the tray (1) and the shaft sleeve of the small gear (2). The bottle support of the invention has a simple structure, and works in a reliable manner. The revolution and rotation of the tray (1) are completely consistent with that of the capping head during working, thus improving cover rolling quality.

3 Claims, 1 Drawing Sheet

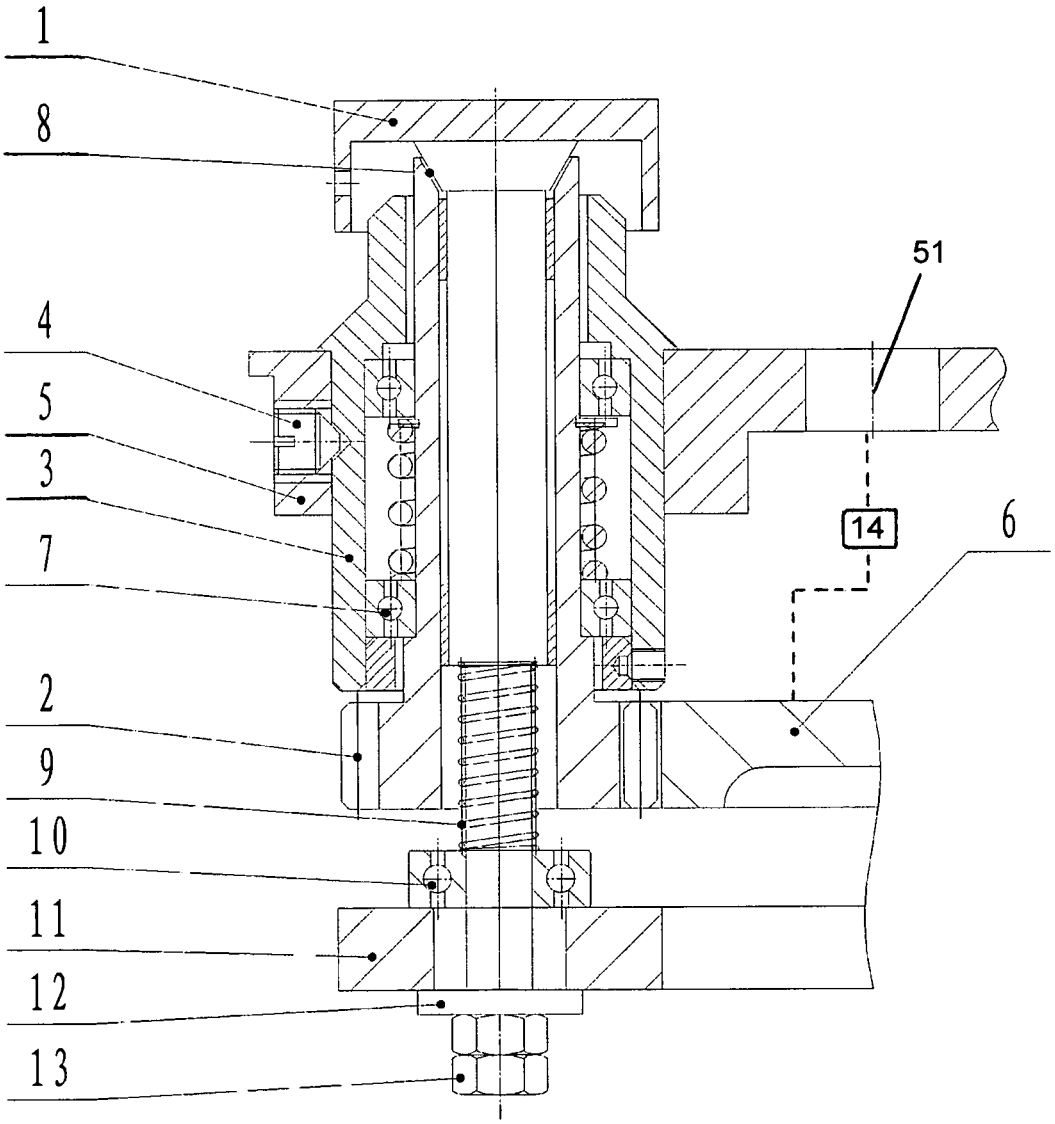
1
8
51
4
5
3
14
6
7
2
9
10
11
12
13

BOTTLE SUPPORTING MEANS WITH CLUTCH

BACKGROUND OF THE PRESENT INVENTION

1. Field of Invention

The present invention relates to a bottle support with clutch control movement mechanism, and more particularly to a bottle support with clutch control which is operatively applied in a capping machine for the medical and food devices.

2. Description of Related Arts

Conventional bottle supporting means for capping machine usually include a tray or bottle support which is control through a cam for upward and downward movement and is provided on a turntable defining a transportation track for the capping machine. When a bottle and a cap is provided on the bottle support for capping, the bottle support moves the bottle and the cap upward towards a capping head such that the capping head is biased against the cap towards the bottle for cutting and capping process. Then, the bottle support moves downward, the capped bottle is removed and another bottle is provided for capping. The bottle support only rotates along the axis of the turntable following the transportation track. The advantage of this kind of bottle support is simple in construction and the disadvantage is unreliable because the movement of the bottle support is passively rotated through the turntable.

SUMMARY OF THE PRESENT INVENTION

The invention is advantageous in that it provides a bottle support with clutch control movement mechanism which is simple, compact and reliable while increasing a quality of the capping for bottles.

Additional advantages and features of the invention will become apparent from the description which follows, and may be realized by means of the instrumentalities and combinations particular point out in the appended claims.

According to the present invention, the foregoing and other objects and advantages are attained by a bottle support with clutch control movement mechanism, comprising: a support member, a first gear, a housing, a turntable, a bearing and a clutch. The first gear is connected to the housing through the bearing. The housing is connected to the turntable. A sleeve portion of the support member is coaxially received and connected into a sleeve portion of the first gear. The clutch is provided between the sleeve portion of the support member and the sleeve portion of the first gear.

Preferably, the clutch provides a connecting surface between the sleeve portion of the bottle support and the sleeve portion of the first gear, wherein the connecting surface is a cone surface or a flat surface.

Preferably, the present invention further comprises a resilient member co-axially provided on the support member and a second bearing, wherein the resilient member is positioned between the second bearing and a top end of the support member.

Preferably, the present invention further comprises a bottom support having a connecting through hole that a bottom end of the support member is extended through the through hole and is coupled with the bottom support; a connecting pad provided on the bottom end of the support member and a bottom connector securely connecting the support member onto the bottom support.

Preferably, the connecting washer has a non-circular hole matching with the bottom end of the support member.

Still further objects and advantages will become apparent from a consideration of the ensuing description and drawings.

These and other objectives, features, and advantages of the present invention will become apparent from the following detailed description, the accompanying drawings, and the appended claims.

BRIEF DESCRIPTION OF THE DRAWINGS

FIG. 1 is a schematic view of a bottle support with clutch control mechanism according to a preferred embodiment of the present invention.

1: support member (tray), 2: first gear (small gear), 3: housing (shell), 4: connecting member (screw), 5: turntable (rotary table), 6: second gear, 7: bearing, 8: clutch, 9: resilient member, 10: second bearing, 11: bottom support (round plate), 12: pad, 13: bottom connector.

DETAILED DESCRIPTION OF THE PREFERRED EMBODIMENT

Referring to FIG. 1 of the drawings, a bottle support with clutch control mechanism, adapted for cooperatively connected to a capping machine for performing a capping process, according to a preferred embodiment of the present invention includes a support member 1, a first gear 2, a housing 3 and a turntable 5. The first gear 2 has a sleeve portion coaxially connecting to the housing 3 through a bearing 7 of the support member 1. The first gear 2 is engaged with a second gear 6, wherein the first gear 2 has a smaller number of teeth of the second gear 6. In other words, the first gear 2 is a small gear compared to the second gear 6. The housing 3, such as a shell, is mounted to the turntable 5 through a connecting member 4 such as a screw. The support member 1, such as a support tray for supporting a bottle thereon, has a connecting portion operatively coupled and coaxially received in the sleeve portion of the first gear 2. Preferably, the connecting portion of the support member 1 is a sleeve portion of the support member 1 to operatively couple with the sleeve portion of the first gear 2 in a coaxial manner. A clutch 8 is provided between the connecting portion of the support member 1 and the sleeve portion of the first gear 2. The turntable 5 is driven to rotate through the operation of a transmission device 14 defining a turntable axis 51 at the center of the turntable 5. The support member 1 is moved along the turntable axis 51 of the turntable 5 while the first gear 2 is meshed with the second gear 6. In other words, the support member 1 is rotated about the turntable axis 51 at the center of the turntable 5, such that the support member 1 is revolved about the turntable 5. When the clutch 8 is engaged with the support member 1, the support member 1 and the first gear 2 are moved together and rotated along their axes respectively. In other words, the support member 1 is driven to rotate at its center axis thereof via the rotational movement of the first gear 2. The support member 1 is also revolved about the turntable 5. When the clutch 8 is disengaged, the first gear 2 is rotated along its axis, while the support member 1 is no longer rotated along its axis and is only rotated with the housing 5 along the turntable axis 51 on the moving track of the turntable 5. The turntable 5 is an automatic turntable operated under the transmission device 14 for rotational movement along the turntable axis 51. The first gear 2 is coaxially engaged with the housing 3 through the bearing 7. The second gear 6 is actuated through the transmission device 14 to actuate a rotational movement of the first gear 2. In other words, the second gear 6 is driven to rotate through the transmission device 14 in order to drive the first gear 2 to rotate.

The sleeve portion of the support member 1 is received in the sleeve portion of the first gear 2 such that a support axis of the support member 1 is defined and the support member 1 is capable of having vertical and rotational movements with respect to the sleeve portion of the first gear 2. The clutch 8 is provided between the support member 1 and the first gear 2. When an external force is applied, the clutch 8 is engaged, the first gear 2 drives the support member 1 for having self-rotational movement along the support axis and is cooperatively work with other parts of the capping machine to perform a capping process. When the external force is released, the clutch 8 is disengaged. The first gear 2 is rotated along its first gear axis while the support member 1 is no longer driven to rotate along the support axis and is moved along with the turntable axis 51 such that a bottle can be removed from or placed onto the support member 1. In this embodiment, the clutch 8 has a connecting surface between the axle of the support member 1 and the sleeve portion of the first gear 2, wherein the connecting surface can be a cone surface which is shown in FIG. 1, or can be a flat surface. In other words, the connecting surface can be a slanted connecting surface or a straight connecting surface. The support member 1 further provides a resilient member 9, such as a spring, coaxially supported along the support axis of the support member 1 and a second bearing 10 provided at a bottom end of the support axis of the support member 1, wherein an upper end of the resilient member 9 is extended towards a top support surface of the support member 1 and a bottom end of the resilient member 9 is extended towards the second bearing 10. When a force is applied downwardly onto the support member 1, the axis of the support member 1 acts against the force of the resilient member 9 and uses the fiction of an operative surface between the axis of the support member 1 and the sleeve portion of the first gear 2 such that the support member 1 is driven by the first gear 2 for self-rotational movement, which is rotational along the support axis of the support member 1. When the support member 1 is having its self-rotational movement, the resilient member 9 and the second bearing 10 which is operatively connected with the resilient member 9 will then be driven to rotate together with the support member 1. In the rotational movement of the support member 1, the resilient member 9 is acted upon or pressed vertically only and is not acted sidewardly, wherein the resilient member 9 will only be compressed by the downward force applied on the support member 1. In other words, torque is not exerted on the resilient member 9 and hence the support member 1 is not driven to move sidewardly or dislodge from its position. The present invention further comprises a bottom support 11, such as a round plate, having a connecting through hole coaxially receiving and coupling a bottom end of the support member 1 along the bottle support axis in a moveable manner such that a height of the bottom support 11 relative to the first gear 2 can be adjusted, wherein an inner thread is provided at the rim surface of the through hole for assisting the height adjustment. A connecting washer 12 and a bottom fastener 13, such as a nut, are provided for securing the bottom support 11 with the support member 1. The bottom support 11 and the turntable 5 is arranged to move simultaneously. The hole of the connecting washer 12 is a non-circular through hole matching with the non-circular bottom end of the support member 1 such that the connecting washer 12 and the support member 1 are not rotated coaxially relative to each other. When the support member 1 is driven by the resilient member 9 for vertical movement, the connecting washer 12 which is connected to the bottom support 11 will produce a restraining effect to stop the self-rotational movement of the support member 1. When the clutch 8 is disengaged, which is the time for removing or placing bottles, an original length of the resilient member 9 is not predictably adjustable while a height requirement of the support member 1 is strict for the operation in relation to other parts of the capping machine to perform the capping process. Therefore, the connecting washer 12 and the bottom fastener 13 can be used for height adjustment.

One skilled in the art will understand that the embodiment of the present invention as shown in the drawings and described above is exemplary only and not intended to be limiting. For example, the structural design of the clutch in which the connecting surface can be a protruded surface or a protruded structure, is encompassed within the spirit and scope of the present invention.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A bottle support, comprising: a support member, a first gear, a housing, a turntable, a bearing, a clutch, and a resilient member, wherein said first gear is connected to said housing through said bearing, said housing being connected to said turntable, wherein a sleeve portion of said bottle support is coaxially received and connected into a sleeve portion of said first gear, wherein said clutch is provided between said sleeve portion of said bottle support and said sleeve portion of said first gear, wherein said clutch is provided at a connecting surface between said sleeve portion of said bottle support and said sleeve portion of said first gear, wherein said connecting surface is a cone surface or a flat surface, said resilient member coaxially provided on said bottle support, and a second bearing, wherein said resilient member is positioned between said second bearing and a top end of said support member.

2. The bottle support, as in claim 1, further comprising a bottom support having a connecting through hole that a bottom end of said support member is extended through said through hole and is coupled with said bottom support; a connecting washer provided on said bottom end of said support member and a bottom fastener securely connecting said support member onto said bottom support.

3. The bottle support, as recited in claim 2, wherein said connecting washer has a non-circular hole matching with said bottom end of said support member.

* * * * *